US010183835B2

(12) United States Patent
Kakita

(10) Patent No.: US 10,183,835 B2
(45) Date of Patent: Jan. 22, 2019

(54) IMAGE FORMING APPARATUS

(71) Applicant: Konica Minolta, Inc., Chiyoda-ku, Tokyo (JP)

(72) Inventor: Akihiko Kakita, Kunitachi (JP)

(73) Assignee: KONICA MINOLTA, INC., Chiyodao-ku, Tokyo (JP)

( * ) Notice: Subject to any disclaimer, the term of this patent is extended or adjusted under 35 U.S.C. 154(b) by 0 days.

(21) Appl. No.: 15/354,626

(22) Filed: Nov. 17, 2016

(65) Prior Publication Data

US 2017/0225917 A1 Aug. 10, 2017

(30) Foreign Application Priority Data

Feb. 10, 2016 (JP) ..... 2016-023684

(51) Int. Cl.
*B65H 85/00* (2006.01)
*B65H 7/00* (2006.01)
(Continued)

(52) U.S. Cl.
CPC ..... *B65H 85/00* (2013.01); *B65H 5/062* (2013.01); *B65H 7/00* (2013.01); *B65H 9/06* (2013.01);
(Continued)

(58) Field of Classification Search
CPC .. B65H 85/00; B65H 15/00; B65H 2301/141; B65H 2301/21; B65H 2301/3121; B65H 2301/333; B65H 2301/3331; B65H 2301/33312; B65H 2301/448; B65H 2301/4482; B65H 2301/44822; B65H 2404/63; B65H 2511/11; B65H 2511/18;
(Continued)

(56) References Cited

U.S. PATENT DOCUMENTS 6,340,157 B1 * 1/2002 Watanabe ..... B65H 15/00 271/186
6,546,228 B2 * 4/2003 Motohashi ..... G03G 15/234 399/124
(Continued)

FOREIGN PATENT DOCUMENTS

JP 03-073769 A 3/1991
JP 11-208962 A 8/1999
JP 2005-338506 A 12/2005

*Primary Examiner* — Ernesto A Suarez
(74) *Attorney, Agent, or Firm* — Squire Patton Boggs (US) LLP

(57) ABSTRACT

An image forming apparatus includes: one paper cassette configured to accommodate a paper sheet; an image forming section provided above the paper cassette to form an image on the paper sheet; a main conveying path configured to convey the paper sheet; and a reverse conveying path configured to reverse the paper sheet, wherein the reverse conveying path includes: a first reverse conveying path provided side by side with the paper cassette to extend vertically; a second reverse conveying path configured to connect from the first reverse conveying path and extend below the paper cassette; a guide plate configured to open and close the first reverse conveying path and release pressure of a pair of paper conveying rollers; and an entry restricting unit provided at a boundary point between the first reverse conveying path and the second reverse conveying path to open and close a conveying course of the paper sheet.

6 Claims, 6 Drawing Sheets

(51) Int. Cl.

| | |
|---|---|
| ***B65H 9/06*** | (2006.01) |
| ***G03G 15/00*** | (2006.01) |
| ***B65H 5/06*** | (2006.01) |
| ***G03G 15/23*** | (2006.01) |

(52) U.S. Cl.
CPC ..... *G03G 15/234* (2013.01); *G03G 15/6529* (2013.01); *G03G 15/6594* (2013.01); *B65H 2404/144* (2013.01); *B65H 2511/11* (2013.01); *B65H 2511/20* (2013.01)

(58) Field of Classification Search
CPC ..... B65H 2511/182; B65H 2511/528; B65H 2601/11; B65H 2601/31; B65H 2601/32; B65H 2601/41; B65H 2601/42; B65H 2601/523; G03G 15/231; G03G 15/232; G03G 15/234; G03G 15/6579; G03G 2215/00586; G03G 2215/2083; G03G 2215/0043
USPC ..... 271/184, 185, 186; 399/364, 401
See application file for complete search history.

(56) References Cited

U.S. PATENT DOCUMENTS

| | | | | |
|---|---|---|---|---|
| 6,549,748 | B2 * | 4/2003 | Miura | G03G 15/234 399/381 |
| 7,142,790 | B2 * | 11/2006 | Takahashi | G03G 15/6529 399/16 |
| 8,899,574 | B2 * | 12/2014 | Okano | B65H 7/00 271/9.09 |
| 8,899,578 | B2 * | 12/2014 | Tomatsu | B41J 3/60 271/186 |
| 9,042,807 | B2 * | 5/2015 | Iino | G03G 15/234 399/401 |
| 2010/0226678 | A1 * | 9/2010 | Sato | B65H 3/44 399/81 |
| 2016/0275389 | A1 * | 9/2016 | Hara | G06K 15/4085 |

* cited by examiner

IMAGE FORMING APPARATUS

The entire disclosure of Japanese Patent Application No. 2016-023684 filed on Feb. 10, 2016 including description, claims, drawings, and abstract are incorporated herein by reference in its entirety.

BACKGROUND OF THE INVENTION

Field of the Invention

The present invention relates to an image forming apparatus including a conveying path where a paper sheet is reversed.

Description of the Related Art

An electrophotographic image forming apparatus includes a function of performing duplex printing after reversing a paper sheet and a function of ejecting a paper sheet with the paper sheet reversed. Recently, printing on a long paper sheet of a size that is more than a regular size such as an A4 size is increasingly demanded of such an image forming apparatus.

A reverse conveying path is a structure for switching a conveying course of the paper sheet by reversing a conveying direction of the paper sheet. A proposed technique provides the reverse conveying path below a paper cassette (refer to, for example, JP 11-208962 A).

The reverse conveying path needs to have a length that is not less than a length of the paper sheet along the conveying direction. Accordingly, to form the reverse conveying path having the length adapted to the long paper sheet inside the image forming apparatus, a proposed technique connects a vertically extending conveying path that is provided side by side with a plurality of vertically aligned paper cassettes and a horizontally extending conveying path that is provided below the lowermost paper cassette.

In the image forming apparatus including the reverse conveying path, when the paper sheet remains jammed in a conveying path where the paper sheet cannot be removed, a proposed technique conveys this paper sheet to a position where the paper sheet can be removed (refer to, for example, JP 2005-338506 A).

To facilitate the removal of the paper sheet from the reverse conveying path, a proposed technique forms a space for the paper sheet removal on a predetermined side of the reverse conveying path (refer to, for example, JP 03-073769A).

The image forming apparatus is provided with, at a part of the conveying path, a structure capable of releasing pressure of a pair of rollers on the paper sheet remaining jammed in the conveying path, thereby facilitating the paper sheet removal.

Moreover, the structure for releasing the pressure of the pair of rollers on the paper sheet is included in a structure for performing paper positional correction that is called registration rocking, so that friction is reduced when the paper sheet is moved in its width direction orthogonal to the conveying direction.

In the reverse conveying path provided side by side with the paper cassettes, a guide plate for guiding the paper sheet during conveyance can structurally be opened and closed by hand for facilitating the removal of the jammed paper sheet, and the pressure of the pair of rollers on the paper sheet can structurally be released in synchronization with the opening of the guide plate.

To remove the paper sheet that is conveyed into the reverse conveying path for duplex printing, for example or the paper sheet that is conveyed into the reverse conveying path where the paper sheet can be removed after remaining jammed in the conveying path where the paper sheet cannot be removed, operation for opening the guide plate is performed.

When the guide plate of the reverse conveying path is opened for removal of the long paper sheet that is conveyed into the reverse conveying path, the long paper sheet remains astride the reverse conveying path provided side by side with the paper cassettes and the reverse conveying path provided below the paper cassettes. Visual identification of the long paper sheet is thus facilitated, and because the pressure of the pair of rollers is also released, the long paper sheet can be removed with ease.

However, when the guide plate of the reverse conveying path is opened for the removal of the long paper sheet with a paper sheet of the regular size conveyed into the reverse conveying path, the pressure of the pair of rollers is released, so that the paper sheet remaining in the reverse conveying path provided side by side with the paper cassettes moves under its own weight into the reverse conveying path provided below the paper cassettes.

The reverse conveying path below the paper cassettes is provided in a narrow space, so that the paper sheet conveyed into this reverse conveying path provided below the paper cassettes is visually hard to identify. The reverse conveying path below the paper cassettes is not provided with, for example, a structure for opening and closing a guide plate, thereby requiring the paper sheet to be pulled out in the conveying direction for removal, which is not easy. To increase the space below the paper cassettes, the apparatus needs to be increased in size. Providing the structure for opening and closing the guide plate also to the reverse conveying path provided below the paper cassettes increases the size of the apparatus and structurally complicates the apparatus.

SUMMARY OF THE INVENTION

The present invention has been made to solve such problems, and an object thereof is to provide an image forming apparatus that facilitates removal of, for example, a jammed paper sheet regardless of paper size and is capable of duplex printing and ejection of a paper sheet with the paper sheet reversed.

To achieve the abovementioned object, according to an aspect, an image forming apparatus reflecting one aspect of the present invention comprises: at least one paper cassette configured to accommodate a paper sheet so that the paper sheet can be sent out; an image forming section provided above the at least one paper cassette and configured to form an image on the paper sheet; a main conveying path configured to convey the paper sheet to be formed with the image in the image forming section; and a reverse conveying path configured to reverse the paper sheet, the reverse conveying path branching off from the main conveying path, wherein the reverse conveying path comprises: a first reverse conveying path provided side by side with the at least one paper cassette and configured to extend vertically, the first reverse conveying path having a length more than a length of the paper sheet of a first size along a conveying direction, the paper sheet of the first size being accommodated by the at least one paper cassette, the length of the first reverse conveying path being less than a length of a paper sheet of a second size along the conveying direction, the second size being more than the first size; a second reverse conveying path configured to connect from the first reverse conveying path and extend below the at least one paper cassette, the second reverse conveying path and the first reverse conveying path having a total length more than the length of the paper sheet of the second size along the conveying direction; a guide plate configured to open and close the first reverse conveying path and release pressure of a pair of paper conveying rollers on the paper sheet; and an entry restricting unit provided at a boundary point between the first reverse conveying path and the second reverse conveying path and configured to open and close a conveying course of the paper sheet.

According to an invention of Item. 2, there is provided the image forming apparatus of Item. 1, preferably further comprising a control section configured to execute such control as to move the entry restricting unit to a conveying course closing position when determining that the paper sheet of the first size and the paper sheet of a size less than the first size undergo image formation, and execute such control as to move the entry restricting unit to a conveying course opening position when determining that the paper sheet of the second size and a paper sheet of a size more than the first size and less than the second size undergo the image formation.

According to an invention of Item. 3, there is provided the image forming apparatus of Item. 2, preferably further comprising an opening/closing detecting unit configured to detect whether the entry restricting unit is in the conveying course closing position or in the conveying course opening position, wherein the control section preferably controls an operation section for such operation guidance as to move the entry restricting unit to the conveying course closing position when determining that the paper sheet of the size not more than the first size undergoes the image formation and also detecting by the opening/closing detecting unit that the entry restricting unit is in the conveying course opening position, and the control section preferably controls the operation section for such operation guidance as to move the entry restricting unit to the conveying course opening position when determining that the paper sheet of the size more than the first size but not more than the second size undergoes the image formation and also detecting by the opening/closing detecting unit that the entry restricting unit is in the conveying course closing position.

According to an invention of Item. 4, there is provided the image forming apparatus of Item. 2, preferably further comprising: a driving unit configured to open and close the entry restricting unit, wherein the control section preferably controls the driving unit to move the entry restricting unit to the conveying course closing position when determining that the paper sheet of the size not more than the first size undergoes the image formation and also detecting by an opening/closing detecting unit that the entry restricting unit is in the conveying course opening position, and the control section preferably controls the driving unit to move the entry restricting unit to the conveying course opening position when determining that the paper sheet of the size more than the first size but not more than the second size undergoes the image formation and also detecting by the opening/closing detecting unit that the entry restricting unit is in the conveying course closing position.

According to an invention of Item. 5, there is provided the image forming apparatus of Item. 1, preferably further comprising an opening/closing member configured to open and close the entry restricting unit in synchronization with closing and opening of a door, wherein the opening/closing member preferably moves the entry restricting unit to a conveying course opening position when the door is closed, and the opening/closing member preferably moves the entry restricting unit to a conveying course closing position when the door is opened.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an image forming apparatus according to an embodiment of the present invention will be described with reference to the drawings. However, the scope of the invention is not limited to the illustrated examples.

<Configuration Example of an Image Forming Apparatus According to the First Embodiment>

Figure 1:
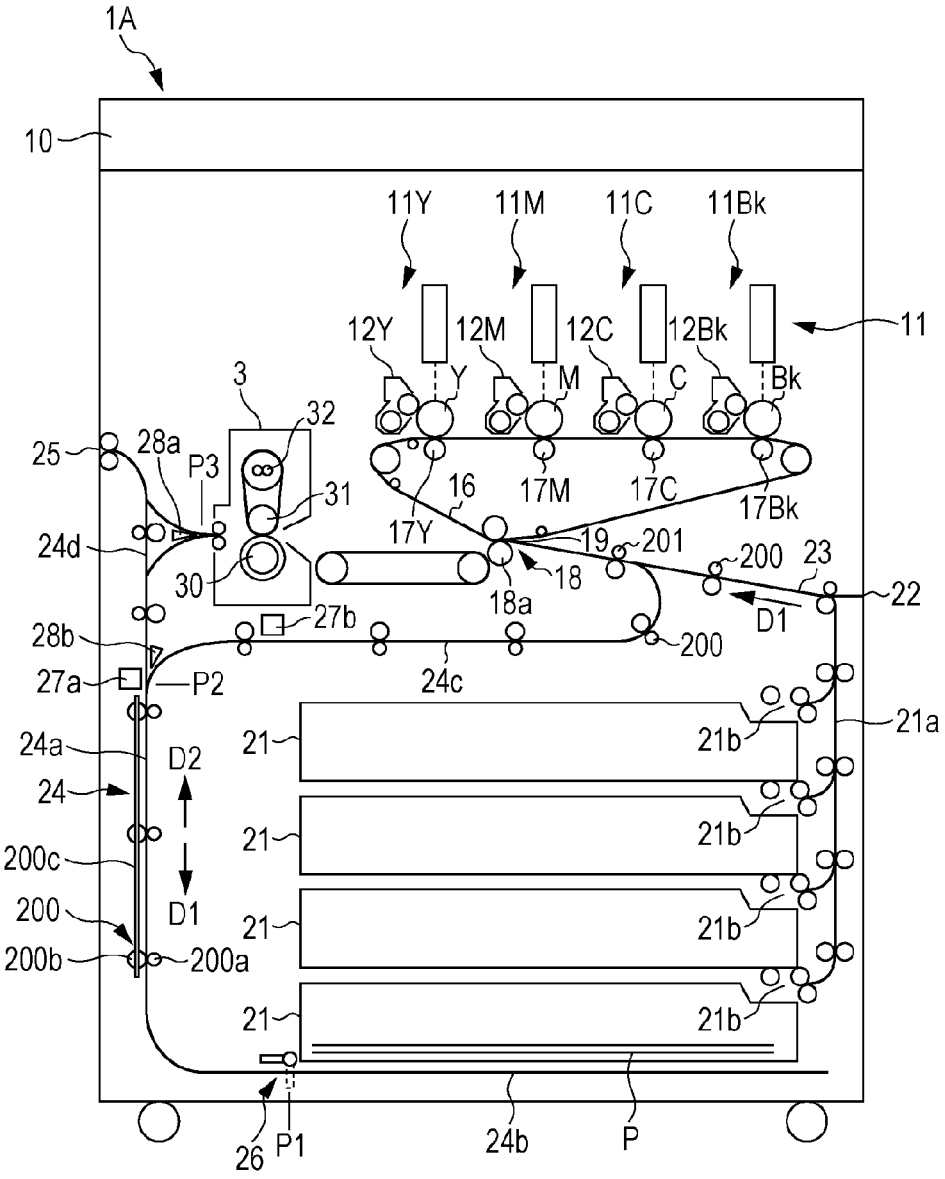
FIG. 1 schematically illustrates a configuration of an image forming apparatus according to a first embodiment of the present invention.

FIG. 1 schematically illustrates the configuration of the image forming apparatus 1A according to the first embodiment. The image forming apparatus 1A is an electrophotographic image forming apparatus such as a copying machine. In the present embodiment, the image forming apparatus 1A is a so-called tandem type color image forming apparatus having a plurality of horizontally arranged photoreceptors facing one intermediate transfer belt for formation of a full-color image.

The image forming apparatus 1A includes a document reader 10, an image forming section 11, a paper conveying section 2, and a fixing section 3.

The document reader 10 performs scanning exposure on an image of a document by means of an optical system of a scanning exposure apparatus and reads resulting reflected light by means of a line image sensor, thus obtaining an image signal. It is to be noted that image forming apparatus 1A may include, at its top, an automatic document feeder, which is not shown in the drawing, for feeding the document.

The image forming section 11 is an example of an image forming means and includes an image forming section 11Y for forming a yellow (Y) image, an image forming section 11M for forming a magenta (M) image, an image forming section 11C for forming a cyan (C) image, and an image forming section 11BK for forming a black (BK) image.

The image forming section 11Y includes a photoreceptor drum Y, a developing device 12Y, and those that are not shown in the drawing, such as a charger, an optical writing unit, and a drum cleaner. Similarly, the image forming sections 11M, 11C, 11BK include respective photoreceptor drums M, C, BK, respective developing devices 12M, 12C, 12BK, and those that are not shown in the drawing, such as respective chargers, respective optical writing units, and respective drum cleaners.

The photoreceptor drum Y is formed with a latent image through scanning exposure. The developing device 12Y develops the latent image formed on the photoreceptor drum Y by using toner for visualization. In this way, the photoreceptor drum Y is formed with an image (toner image) of a predetermined color corresponding to yellow.

Similarly, the photoreceptor drum M is formed with a latent image through scanning exposure. The developing device 12M develops the latent image formed on the photoreceptor drum M by using toner for visualization. In this way, the photoreceptor drum M is formed with a toner image of a predetermined color corresponding to magenta.

The photoreceptor drum C is formed with a latent image through scanning exposure. The developing device 12C develops the latent image formed on the photoreceptor drum C by using toner for visualization. In this way, the photoreceptor drum C is formed with a toner image of a predetermined color corresponding to cyan.

The photoreceptor drum BK is formed with a latent image through scanning exposure. The developing device 12BK develops the latent image formed on the photoreceptor drum BK by using toner for visualization. In this way, the photoreceptor drum BK is formed with a toner image of a predetermined color corresponding to black.

The images formed on the respective photoreceptor drums Y, M, C, BK are transferred one after another by respective primary transfer rollers 17Y, 17M, 17C, 17BK to a predetermined position of the intermediate transfer belt 16 that is a belt type intermediate transfer body.

In a secondary transfer section 18, the colored images transferred to the intermediate transfer belt 16 are transferred to a paper sheet P conveyed in predetermined timing by the paper conveying section 2. While conveying the paper sheet P, the secondary transfer section 18 transfers the images to the paper sheet P by means of a transfer nip part 19 that is formed by a secondary transfer roller 18*a* pressed against the intermediate transfer belt 16.

The paper conveying section 2 includes a plurality of paper cassettes 21 in the present embodiment for accommodating paper sheets P, a main conveying path 23 for conveying the paper sheet P fed from the paper cassette 21 or from an external paper feeder 22 connecting with those that are not shown in the drawing, such as an external paper feed tray and an external paper feeding device, and a reverse conveying path 24 for reversing the paper sheet P.

The plurality of paper cassettes 21 is mounted in a lower part of the image forming apparatus 1A to align vertically and can be detached independently. The paper sheets P are accommodated by each of the paper cassettes 21 substantially in horizontally oriented condition and are stacked vertically.

The paper conveying section 2 further includes the external paper feeder 22 at one side of the image forming apparatus 1A and an ejector 25 at another side of the image forming apparatus 1A. The main conveying path 23 is provided above the uppermost paper cassette 21. This main conveying path 23 connects with a paper feeding path 21*a* and the external paper feeder 22 at an upstream side of a conveying direction of the paper sheet P that is indicated by arrow D1 and connects with the reverse conveying path 24 and the ejector 25 at a downstream side of the conveying direction.

The paper feeding path 21*a* is provided side by side with the paper cassettes 21 at the one side of the image forming apparatus 1A, extends in a substantially vertical direction and connects with a paper feeder 21*b* of each of the paper cassettes 21. The paper feeder 21*b* sends out the paper sheets P accommodated by the paper cassette 21 one by one.

The reverse conveying path 24 includes a first reverse conveying path 24*a* that downwardly branches off downstream of the fixing section 3 from the main conveying path 23 in the conveying direction of the paper sheet P that is indicated by arrow D1. The first reverse conveying path 24*a* is provided side by side with the paper cassettes 21 at the other side of the image forming apparatus 1A and extends in a substantially vertical direction. This first reverse conveying path 24*a* is formed with, at its lower end, a conveying path curved on such a radius that the paper sheet P can pass through.

The reverse conveying path 24 further includes a second reverse conveying path 24*b* connecting with the first reverse conveying path 24*a*. The second reverse conveying path 24*b* is provided below the lowermost paper cassette 21 in the lower part of the image forming apparatus 1A and extends in a substantially horizontal direction from the other side to the one side of the image forming apparatus 1A.

The reverse conveying path 24 further includes a third reverse conveying path 24*c* that branches off from the first reverse conveying path 24*a* and connects with the main conveying path 23. The third reverse conveying path 24*c* is provided between the main conveying path 23 and the uppermost paper cassette 21 and extends in a substantially horizontal direction. The third reverse conveying path 24*c* is formed with, at its side branching from the first reverse conveying path 24*a*, a conveying path curving transversely from the first reverse conveying path 24*a* along the conveying direction of the paper sheet P that is indicated by arrow D2. The third reverse conveying path 24*c* is also formed with, at its side connecting with the main conveying path 23, a conveying path curving upward, thereby joining the main conveying path 23 upstream of a registration roller 201, which is described later, in the conveying direction of the paper sheet P that is indicated by arrow D1.

The reverse conveying path 24 further includes a fourth reverse conveying path 24*d* that branches off from the first reverse conveying path 24*a* and connects with the ejector 25. The fourth reverse conveying path 24*d* branches off from the first reverse conveying path 24*a* downstream of a branch point P2 between the first reverse conveying path 24*a* and the third reverse conveying path 24*c* in the conveying direction of the paper sheet P that is indicated by arrow D2.

The paper conveying section 2 further includes conveying rollers 200 for conveying the paper sheet P. The conveying rollers 200 include pairs of rollers each of which faces each other across a conveying course of the paper sheet P in the main conveying path 23 and pairs of rollers each of which faces each other across the conveying course of the paper sheet P in the reverse conveying path 24. In each of the conveying rollers 200, with one of the pair of rollers pressing the paper sheet P against the other roller, the other roller is rotatively driven, whereby the paper sheet P is conveyed.

The paper conveying section 2 further includes the registration roller 201 for performing on the paper sheet P conveyed through the main conveying path 23 or the reverse conveying path 24 correction of positional deviation of the paper sheet P in a width direction of the paper sheet P that is orthogonal to the conveying direction indicated by arrow D1 and correction of an inclination of the paper sheet P that is called a skew.

The registration roller 201 is formed of a pair of rollers facing each other across the conveying course of the paper sheet P in the main conveying path 23.

In the image forming apparatus 1A, with rotation of the registration roller 201 being stopped while having the pair of rollers of the registration roller 201 pressed, the paper sheet P is conveyed in the direction of arrow D1, thereby being brought into abutment against a nip part of a contact part of the pair of rollers of the registration roller 201. The paper sheet P is conveyed until the paper sheet P curls up to form what is referred to as a loop, thus having its inclination corrected along its surface.

After the inclination of the paper sheet P is corrected, the registration roller 201 is rotatively driven, whereby the paper sheet P is conveyed with its inclination corrected. Moving the registration roller 201 in the width direction of the paper sheet P that is orthogonal to the conveying direction of the paper sheet P effects correction of a widthwise position of the paper sheet P. As described above, a series of the paper positional corrections for correcting the positional deviation of the paper sheet P in the width direction of the paper sheet P is called registration rocking.

In the registration rocking, the conveying roller 200 that is positioned upstream of the registration roller 201 in the paper conveying direction indicated by arrow D1 undergoes separation from the paper sheet P. Accordingly, friction caused to the paper sheet P by the conveying roller 200 reduces while the paper sheet P is moved widthwise.

The paper conveying section 2 further includes an entry restricting unit 26 at a boundary point P1 between the first reverse conveying path 24*a* and the second reverse conveying path 24*b*. The entry restricting unit 26 is formed to project into and retract from the conveying course of the paper sheet P conveyed through the first reverse conveying path 24*a*. When the entry restricting unit 26 is retracted from the conveying course of the paper sheet P, the paper sheet P can be conveyed into the second reverse conveying path 24*b*. On the other hand, by projecting into the conveying course of the paper sheet P, the entry restricting unit 26 undergoes abutment by a leading end of the paper sheet P conveyed through the first reverse conveying path 24*a* in the direction of arrow D1, thus restricting conveyance of the paper sheet P toward the second reverse conveying path 24*b*.

The paper conveying section 2 further includes a duplex reverse sensor 27*a* at the branch point P2 between the first reverse conveying path 24*a* and the third reverse conveying path 24*c*. The duplex reverse sensor 27*a* is provided in such a position as to be capable of detecting a rear end of the paper sheet P conveyed through the first reverse conveying path 24*a* in the direction of arrow D1 passing the branch point P2 between the first reverse conveying path 24*a* and the third reverse conveying path 24*c*.

The paper conveying section 2 further includes a paper detecting sensor 27*b* in the third reverse conveying path 24*c*. The paper detecting sensor 27*b* is provided in such a position as to be capable of detecting presence of the paper sheet P in the third reverse conveying path 24*c*.

The first reverse conveying path 24*a* includes the driving rollers 200*a* for rotative driving, the driven rollers 200*b* for pressing the paper sheet P against the respective driving rollers 200*a*, and a guide plate 200*c* mounted with the driven rollers 200*b*. The pair of the driving roller 200*a* and the driven roller 200*b* forms each of the conveying rollers 200.

The guide plate 200*c* can structurally open and close the first reverse conveying path 24*a* in such a direction that the driven rollers 200*b* separate from and come into contact with the respective driving rollers 200*a*. As the guide plate 200*c* is opened, the driven rollers 200*b* separate from the respective driving rollers 200*a*.

In the present embodiment, the guide plate 200*c* is rotatably supported by a shaft, which is not shown in the drawing, at an inner side of the image forming apparatus 1A, and through rotation of the guide plate 200*c* around the shaft, a front side of the image forming apparatus 1A is opened or closed. In cases where the paper sheet P remains in the first reverse conveying path 24*a*, opening the guide plate 200*c* enables removal of the paper sheet P from the first reverse conveying path 24*a*.

The paper conveying section 2 further includes a switching gate 28*a* at a branch point P3 between the main conveying path 23 and the reverse conveying path 24. The switching gate 28*a* switches the conveying course of the paper sheet P that is conveyed through the main conveying path 23 in the direction of arrow D1 over to the ejector 25 or to the reverse conveying path 24.

The paper conveying section 2 further includes a switching gate 28*b* at the branch point P2 between the first reverse conveying path 24*a* and the third reverse conveying path 24*c*. The switching gate 28*b* switches the conveying course of the paper sheet P that is conveyed through the first reverse conveying path 24*a* in the direction of arrow D2 over to the third reverse conveying path 24*c* or the fourth reverse conveying path 24*d*.

In the reverse conveying path 24, a length of the first reverse conveying path 24*a*, that is, a length from the branch point P2 between the first reverse conveying path 24*a* and the third reverse conveying path 24*c* to the entry restricting unit 26 is made more than a length of the paper sheet P of a first size along the conveying direction. The first size is a maximum regular size that the paper cassette 21 can accommodate. Accordingly, the paper sheet P of the maximum regular size can be conveyed into the first reverse conveying path 24*a* with the entry restricting unit 26 projecting into the conveying course of the paper sheet P.

In the reverse conveying path 24, a total length of the first reverse conveying path 24*a* and the second reverse conveying path 24*b*, that is, a length from the branch point P2 between the first reverse conveying path 24*a* and the third reverse conveying path 24*c* to a terminal end of the second reverse conveying path 24*b* is made more than a length of a predetermined paper sheet of a second size such as a long paper sheet along the conveying direction. The second size is more than the maximum regular size of the paper sheet P that the paper cassette 21 can accommodate. Accordingly, the long paper sheet can be conveyed into the first reverse conveying path 24*a* and the second reverse conveying path 24*b* with the entry restricting unit 26 retracted from the conveying course of the paper sheet P.

In the image forming apparatus 1A, the paper sheet P conveyed through the main conveying path 23, the secondary transfer section 18, and the fixing section 3 is formed with an image on its surface facing upward. When duplex image formation is performed on the paper sheet P or when the paper sheet P is reversed for ejection, the paper sheet P formed with the image on its upward facing surface is conveyed from the main conveying path 23 into the first reverse conveying path 24*a* of the reverse conveying path 24. When the duplex image formation is performed on the long paper sheet or when the long paper sheet is reversed for ejection, the long paper sheet is conveyed to lie astride the first reverse conveying path 24*a* and the second reverse conveying path 24*b*.

When undergoing the duplex image formation, the paper sheet P conveyed into the first reverse conveying path 24*a* is conveyed into the main conveying path 23 through the third reverse conveying path 24*c*, whereby its surface formed with the image faces downward. In this way, the paper sheet P is reversed, and its other surface facing upward can be formed with an image. The same goes for the long paper sheet.

When undergoing the ejection after being reversed, the paper sheet P conveyed into the first reverse conveying path 24*a* is conveyed to the ejector 25 through the fourth reverse conveying path 24*d*, whereby its surface formed with the image faces downward. In this way, the paper sheet P is reversed and ejected. The same goes for the long paper sheet.

The fixing section 3 fixes the images on the paper sheet P that are transferred to the paper sheet P by the secondary transfer section 18. The fixing section 3 includes a pair of fixing members, that is, a fixing roller 30 and a fixing roller 31 that are disposed in mutually pressed relation.

The fixing section 3 further includes a fixing heater 32 as a heating means for heating the fixing roller 30. While conveying the paper sheet P, the fixing section 3 performs pressure fixing by means of the pair of fixing rollers 30, 31 and heat fixing by means of the fixing heater 32, thereby fixing the images on the paper sheet P.

<Configuration Example of the Entry Restricting Unit 26 According to the Present Embodiment>

Figure 2A:
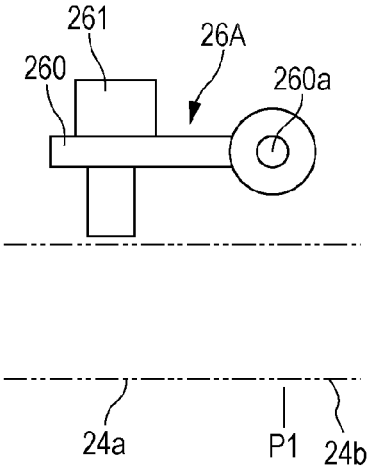
FIGS. 2A and 2B show a configuration of an example of an entry restricting unit according to the first embodiment.
Figure 2B:
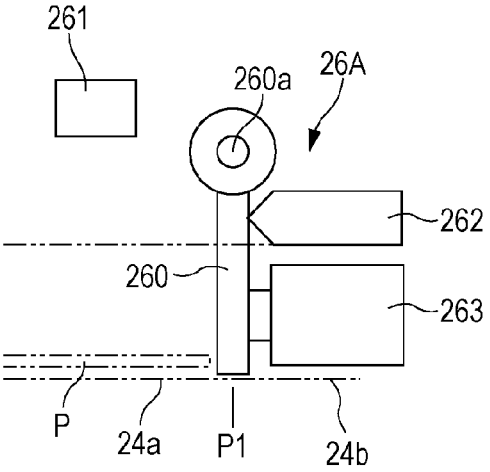

FIGS. 2A and 2B show the configuration of an example of the entry restricting unit 26 according to the first embodiment. The entry restricting unit 26A of the first embodiment includes an entry restricting plate 260, a magnet 261 for holding the entry restricting plate 260 in a retracted position, a stopper 262 for restricting the entry restricting plate 260 in a conveying course closing position, and an opening/closing detecting sensor 263 that is an opening/closing detecting unit for detecting the entry restricting plate 260 being in the conveying course closing position.

In the entry restricting unit 26A, the entry restricting plate 260 is rotated around a shaft 260*a* by hand, thereby closing or opening the conveying course of the paper sheet P at the boundary point P1 between the first reverse conveying path 24*a* and the second reverse conveying path 24*b*.

In the entry restricting unit 26A, as the entry restricting plate 260 is moved to a conveying course opening position, the magnet 261 attracts the entry restricting plate 260 as shown in FIG. 2A. In this way, the entry restricting unit 26A is held in the conveying course opening position where the entry restricting plate 260 is retracted from the conveying course of the paper sheet P.

In the entry restricting unit 26A, as the entry restricting plate 260 is moved toward the conveying course closing position, the entry restricting plate 260 abuts on the stopper 262 under its own weight as shown in FIG. 2B and is detected by the opening/closing detecting sensor 263. In this way, the entry restricting unit 26A is held in the conveying course closing position where the entry restricting plate 260 projects into the conveying course of the paper sheet P, and the opening/closing detecting sensor 263 detects that the entry restricting plate 260 has moved to the conveying course closing position.

<Example of Control Operation of the Image Forming Apparatus 1A According to the Present Embodiment>

Figure 3:
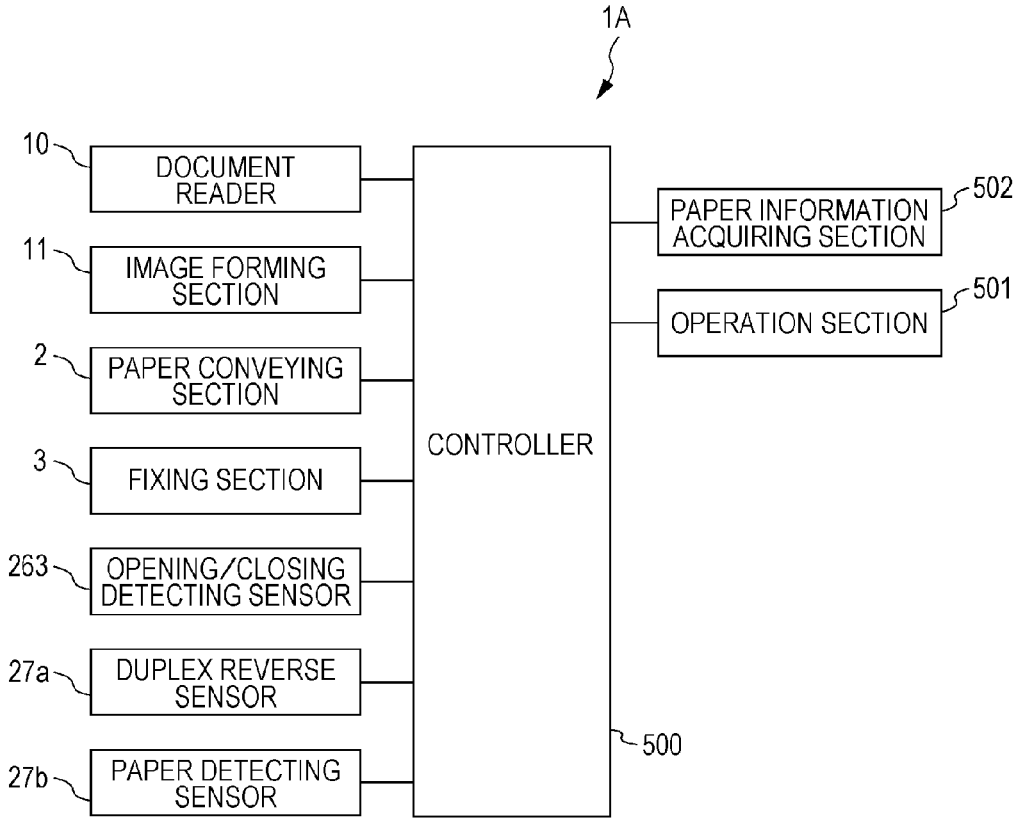
FIG. 3 is a functional block diagram showing an example of control operation of the image forming apparatus according to the first embodiment.

FIG. 3 is a functional block diagram showing the example of the control operation of the image forming apparatus 1A according to the present embodiment. The image forming apparatus 1A includes a controller 500 for executing a series of controls associated with the feeding of the paper sheet P, the image formation, and the paper ejection. The controller 500 is an example of a control section and includes microprocessors that are called a CPU and an MPU, and memories such as a RAM and a ROM.

In an explanation of normal operation of the image forming apparatus 1A, that is, the image formation on the paper sheet P, the controller 500 controls the paper conveying section 2 so that the paper sheet P is conveyed. Based on the image data obtained from the document by the document reader 10 or an image data obtained externally, the controller 500 controls the image forming section 11 so that the images are formed on the paper sheet P. The controller 500 also controls the fixing section 3 so that the paper sheet P has the images fixed, is thus formed with the image and is ejected.

Based on size information of the paper sheet P that is selected at an operation section 501 including an output device such as a display for notifying a user of information and an input device including a touch panel and buttons for receiving input of information by the user or based on size information of the paper sheet P that is obtained by a paper information acquiring section 502, the controller 500 determines whether the entry restricting plate 260 of the entry restricting unit 26A should be in the conveying course closing position or in the conveying course opening position.

Based on the determination as to whether the entry restricting plate 260 should be in the conveying course closing position or in the conveying course opening position and based on an opening/closing status of the entry restricting plate 260 that is detected by the opening/closing detecting sensor 263, the controller 500 determines whether to permit execution of a job. When the controller 500 determines that the entry restricting plate 260 should be in the conveying course closing position and also determines by means of the opening/closing detecting sensor 263 that the entry restricting plate 260 is in the conveying course opening position, the controller 500 gives operation guidance prompting operation for closing the entry restricting plate 260 by, for example, outputting predetermined information to the operation section 501. On the other hand, when the controller 500 determines that the entry restricting plate 260 should be in the conveying course opening position and also determines by means of the opening/closing detecting sensor 263 that the entry restricting plate 260 is in the conveying course closing position, the controller 500 gives operation guidance prompting operation for opening the entry restricting plate 260.

<Example of Operation of the Image Forming Apparatus 1A according to the Present Embodiment>

Figure 4:
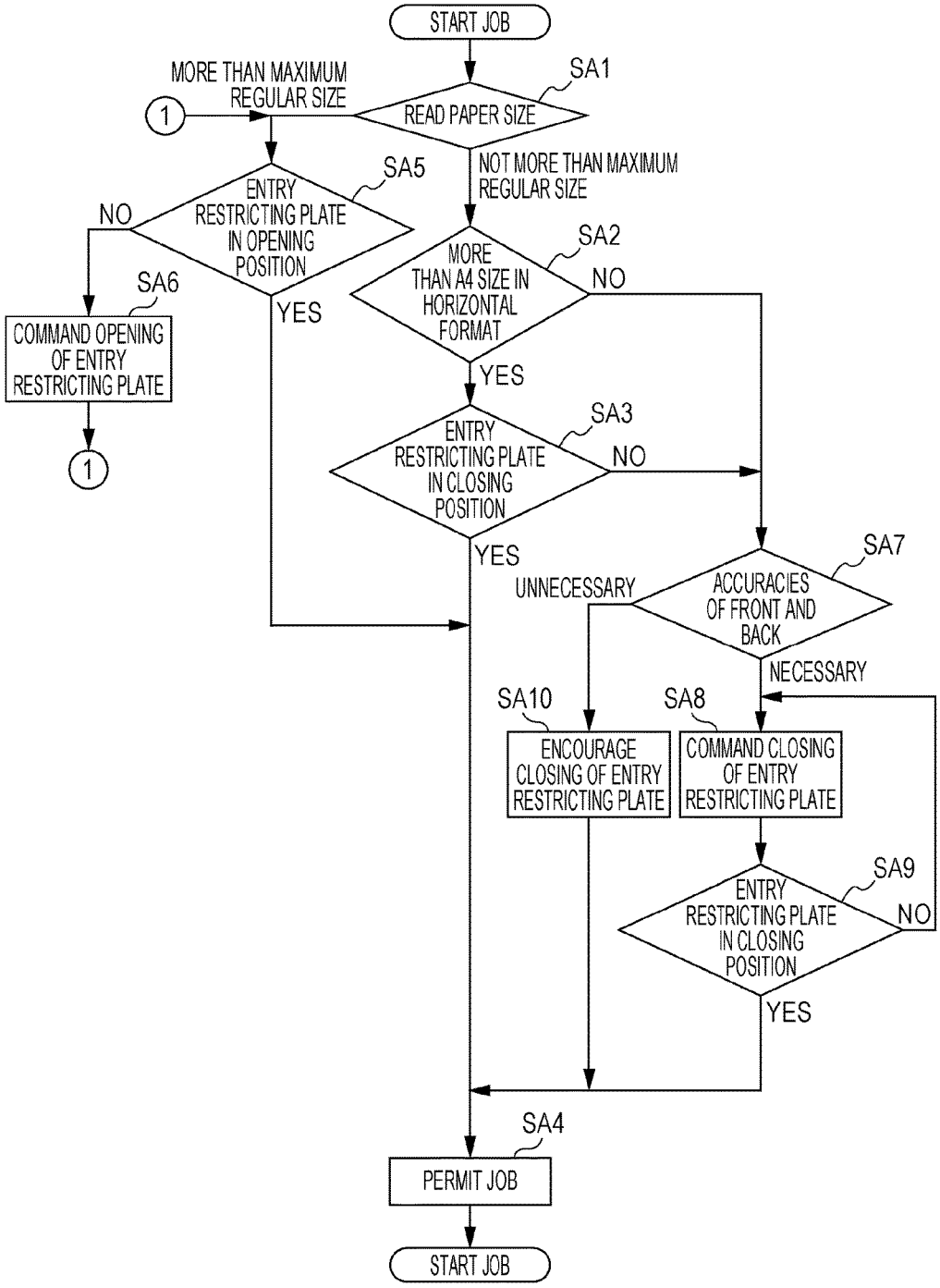
FIG. 4 is a flowchart showing an example of operation of the image forming apparatus according to the first embodiment.

FIG. 4 is a flowchart showing the example of the operation of the image forming apparatus 1A according to the present embodiment. Upon receipt of a command for execution of the job, the controller 500 determines in step SA1 of FIG. 4 whether the paper sheet P that undergoes image formation is of a size more than or not more than the maximum regular size based on the size information of the paper sheet P that is selected at the operation section 501 or the size information of the paper sheet P that is obtained by the paper information acquiring section 502.

In cases where the maximum regular size that the paper cassette 21 can accommodate is, for example, an A4 size in a vertical format, that is, an A4 size having its longitudinal direction oriented along the conveying direction, the controller 500 determines whether the size of the paper sheet P that undergoes the image formation is more than the A4 size in the vertical format but not more than a size of a long paper sheet having a setting indicating that image formation is possible in the image forming apparatus 1A or not more than the A4 size in the vertical format.

When it is determined in step SA1 of FIG. 4 that the size of the paper sheet P is not more than the maximum regular size, the controller 500 determines in step SA2 whether the size of the paper sheet P that undergoes the image formation is more than an A4 size in a horizontal format or not more than the A4 size in the horizontal format.

When it is determined in step SA2 of FIG. 4 that the size of the paper sheet P that undergoes the image formation is more than the A4 size in the horizontal format, that is, more than the A4 size in the horizontal format but not more than the A4 size in the vertical format, the controller 500 determines in step SA3 whether the entry restricting plate 260 is detected by the opening/closing detecting sensor 263, that is, whether the entry restricting plate 260 is in the conveying course closing position.

When it is determined in step SA3 of FIG. 4 that the entry restricting plate 260 is in the conveying course closing position, the controller 500 permits the execution of the job in step SA4. To undergo duplex printing or to be ejected after being reversed, the paper sheet P is conveyed into the reverse conveying path 24. In addition, when jammed, for example, the paper sheet P is conveyed into the reverse conveying path 24.

In the reverse conveying path 24, when the guide plate 200*c* is opened for removal of, for example, the jammed paper sheet P, the pressure of the pairs of rollers is released, so that the paper sheet P conveyed into the first reverse conveying path 24*a* moves under its own weight.

In cases where the size of the paper sheet P that undergoes the image formation is not more than the A4 size in the vertical format, with the entry restricting plate 260 being in the conveying course opening position, the paper sheet P moving under its own weight as a result of the opening of the guide plate 200*c* goes into the second reverse conveying path 24*b* from the first reverse conveying path 24*a*. Since the second reverse conveying path 24*b* is provided below the paper cassettes 21, the paper sheet P is hard to remove from the second reverse conveying path 24*b*.

Accordingly, when the size of the paper sheet P that undergoes the image formation is not more than the A4 size in the vertical format, the execution of the job is permitted after it is confirmed that the entry restricting plate 260 is in the conveying course closing position. Consequently, the paper sheet P moving under its own weight as the result of the opening of the guide plate 200*c* abuts on the entry restricting plate 260, thus remaining in the first reverse conveying path 24*a*. The paper sheet P remaining in the first reverse conveying path 24*a* can be identified visually and removed with ease when the guide plate 200*c* is opened.

When it is determined in step SA1 of FIG. 4 that the size of the paper sheet P is more than the maximum regular size, the controller 500 determines in step SA5 whether the entry restricting plate 260 is not detected by the opening/closing detecting sensor 263, that is, whether the entry restricting plate 260 is in the conveying course opening position.

When it is determined in step SA5 of FIG. 4 that the entry restricting plate 260 is in the conveying course opening position, the controller 500 permits the execution of the job in step SA4. On the other hand, when it is determined in step SA5 of FIG. 4 that the entry restricting plate 260 is not in the conveying course opening position, the controller 500 gives in step SA6 the operation guidance prompting the operation for opening the entry restricting plate 260.

In cases where the paper sheet P that undergoes the image formation is the long paper sheet of the size more than the maximum regular size, with the entry restricting plate 260 being in the conveying course closing position, the long paper sheet conveyed into the first reverse conveying path 24*a* abuts on the entry restricting plate 260, so that a rear end of the long paper sheet cannot be conveyed to a position beyond the branch point P2 between the first reverse conveying path 24*a* and the third reverse conveying path 24*c*.

Accordingly, when the paper sheet P that undergoes the image formation is the long paper sheet, the execution of the job is permitted after it is confirmed that the entry restricting plate 260 is in the conveying course opening position. Consequently, when undergoing duplex printing, the long paper sheet is conveyed into the second reverse conveying path 24*b*, whereby the rear end of the long paper sheet can be conveyed to the position beyond the branch point P2 between the third reverse conveying path 24*c* and the fourth reverse conveying path 24*d*. The long paper sheet is thereafter conveyed into the main conveying path 23 through the third reverse conveying path 24*c*, thus enabling, for example, the duplex printing. In addition, when jammed, the long paper sheet can have its rear end conveyed to the position beyond the branch point P2 between the first reverse conveying path 24*a* and the third reverse conveying path 24*c*, so that the long paper sheet can be prevented from remaining astride conveying units when the specified conveying unit is pulled out.

When it is determined in step SA2 of FIG. 4 that the size of the paper sheet P that undergoes the image formation is not more than the A4 size in the horizontal format or when it is determined in step SA2 that the size of the paper sheet P that undergoes the image formation is more than the A4 size in the horizontal format and then determined in step SA3 that the entry restricting plate 260 is not in the conveying course closing position, the controller 500 determines in step SA7 whether accuracies of a front printing position and a back printing position are required in processing for duplex printing.

When it is determined in step SA7 of FIG. 4 that the accuracies of the front and back printing positions are required in the processing for the duplex printing, the controller 500 gives in step SA8 the operation guidance prompting the operation for closing the entry restricting plate 260. When it is determined in step SA9 of FIG. 4 that the entry restricting plate 260 is in the conveying course closing position, the controller 500 permits the execution of the job in step SA4.

In cases where the accuracies of the front and back printing positions are required in the processing for the duplex printing, there are cases where the pressure of the pairs of rollers of the conveying rollers 200 is released for the registration rocking with the paper sheet P conveyed into the reverse conveying path 24.

When the guide plate 200*c* is opened for removal of the paper sheet P of the size not more than the A4 size during, for example, jamming with the paper sheet P conveyed into the first reverse conveying path 24*a* for the duplex printing, the pressure of all the pairs of rollers contacting the paper sheet P is released, so that the paper sheet P moves under its own weight.

There are also cases where the paper sheet P of the size more than the A4 size in the horizontal format is on standby for the duplex printing while lying astride the third reverse conveying path 24*c* and the first reverse conveying path 24*a*. When the guide plate 200*c* is opened for removal of this paper sheet P during, for example, jamming with the pressure of the pairs of rollers of the conveying rollers 200 released for registration rocking of a previous paper sheet, the paper sheet P put on standby moves under its own weight because the pressure of all the pairs of rollers contacting this paper sheet P is released.

For the above reason, with the entry restricting plate 260 being in the conveying course opening position, the paper sheet P moving under its own weight as a result of the opening of the guide plate 200*c* goes into the second reverse conveying path 24*b* from the first reverse conveying path 24*a*. Since the second reverse conveying path 24*b* is provided below the paper cassettes 21, the paper sheet P is hard to remove from the second reverse conveying path 24*b*.

Accordingly, when the accuracies of the front and back printing positions are required in the processing for the duplex printing, the execution of the job is permitted after it is confirmed that the entry restricting plate 260 is in the conveying course closing position. Consequently, the paper sheet P moving under its own weight as the result of the opening of the guide plate 200*c* abuts on the entry restricting plate 260, thus remaining in the first reverse conveying path 24*a*. Thus, the paper sheet P remaining in the first reverse conveying path 24*a* can be identified visually and removed with ease when the guide plate 200*c* is opened.

When it is determined in step SA7 of FIG. 4 that the accuracies of the front and back printing positions are not required in the processing for the duplex printing, the controller 500 gives in step SA10 operation guidance encouraging the operation for closing the entry restricting plate 260. In the absence of the registration rocking, the pressure of the pairs of rollers of the conveying rollers 200 is not released. When the paper sheet P of the size not more than the A4 size undergoes the duplex printing, the rear end of the paper sheet P is conveyed to a position where it is detected by the paper detecting sensor 27*b*, so that the paper sheet P does not move under its own weight in the third reverse conveying path 24*c*. For this reason, although the entry restricting plate 260 may be opened, the closing of the entry restricting plate 260 is encouraged.

As described above, the opening/closing status of the entry restricting plate 260 is detected by the opening/closing detecting sensor 263, whereby the determination can be made as to whether the paper sheet P is present only in the first reverse conveying path 24*a* or astride the first reverse conveying path 24*a* and the second reverse conveying path 24*b*. The opening/closing detecting sensor 263 thus allows a reduced number of the paper detecting sensors disposed and can detect a conveying status of the paper sheet P.

It is to be noted that the size of the paper sheet P is not limited to any of those in the above embodiment. The paper sheet of the maximum regular size that the paper cassette 21 can accommodate may be of an A3 size or another size. The determination as to whether to open or close the entry restricting plate 260 is made based on the size of the paper sheet P and the accuracies of the front and back printing positions but may be made based on the size of the paper sheet P only. For example, such control as to bring the entry restricting plate 260 to the conveying course closing position may be carried out when the size of the paper sheet P is not more than the maximum regular size that the paper cassette 21 can accommodate, and such control as to bring the entry restricting plate 260 to the conveying course opening position may be carried out when the paper sheet P is the long paper sheet of the size more than the maximum regular size but not more than the predetermined size enabling the image formation and the paper reversing.

<Configuration Examples of the Entry Restricting Unit 26 according to Other Embodiments>

Figure 5A:
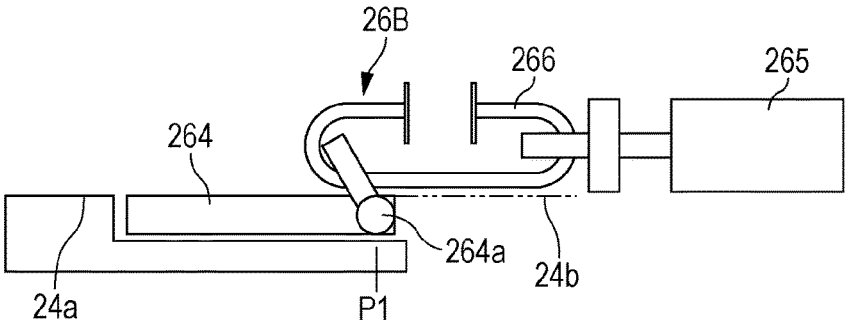
FIGS. 5A and 5B show a configuration of an example of an entry restricting unit according to a second embodiment of the present invention.
Figure 5B:
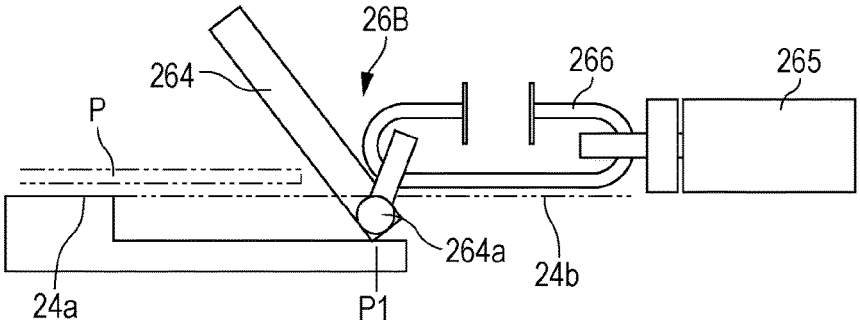

FIGS. 5A and 5B show the configuration of an example of the entry restricting unit 26 according to the second embodiment. The entry restricting unit 26B of the second embodiment includes an entry restricting plate 264, a solenoid 265 that is a driving unit for opening and closing the entry restricting plate 264, and a transmission member 266 for transmitting movement of the solenoid 265 to the entry restricting plate 264.

In the entry restricting unit 26B, the entry restricting plate 264 is rotated around a shaft 264*a*, thereby opening or closing a conveying course of a paper sheet P at the boundary point P1 between the first reverse conveying path 24*a* and the second reverse conveying path 24*b*.

With the entry restricting plate 264 moved to a conveying course opening position, as shown in FIG. 5A, the entry restricting unit 26B is held in the conveying course opening position where the entry restricting plate 264 is retracted from the conveying course of the paper sheet P. When the solenoid 265 is driven with the entry restricting plate 264 moved to the conveying course opening position, as shown in FIG. 5B, the entry restricting plate 264 moves to a conveying course closing position, and the entry restricting unit 26B is held in the conveying course closing position where the entry restricting plate 264 projects into the conveying course of the paper sheet P.

When the controller 500 described with reference to FIG. 3 determines that the paper sheet P that undergoes image formation is of a size more than a predetermined size, the controller 500 drives the solenoid 265 to cause the entry restricting plate 264 to move to the conveying course opening position. Accordingly, in operation for the image formation on the paper sheet P that is of the size more than the predetermined size, such as a long paper sheet, the paper sheet P can be conveyed further from the first reverse conveying path 24*a* into the second reverse conveying path 24*b*. Consequently, the paper sheet P can undergo duplex printing or can be ejected after being reversed.

When the controller 500 determines that the paper sheet P that undergoes the image formation is of a size not more than the predetermined size or when the controller 500 determines that the paper sheet P that undergoes the image formation is of a size not more than the predetermined size and then determines that accuracies of a front printing position and a back printing position are required in processing for the duplex printing, the controller 500 drives the solenoid 265 to cause the entry restricting plate 264 to move to the conveying course closing position.

Accordingly, even when the paper sheet P moves under its own weight as the guide plate 200*c* is opened for removal of the paper sheet P during, for example, jamming with the pressure of the pairs of rollers of the conveying rollers 200 released for registration rocking, the paper sheet P abuts on the entry restricting plate 264, thus remaining in the first reverse conveying path 24*a*. The paper sheet P remaining in the first reverse conveying path 24*a* can be identified visually and removed with ease when the guide plate 200*c* is opened.

Figure 6A:
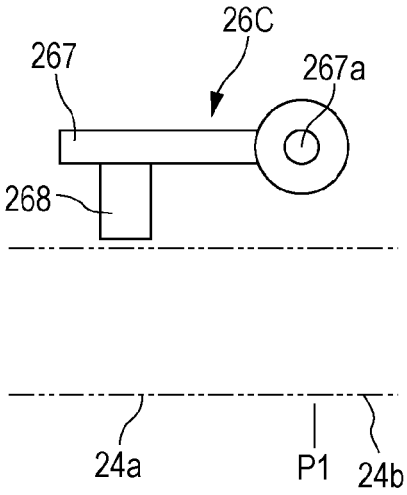
FIGS. 6A and 6B show a configuration of an example of an entry restricting unit according to a third embodiment of the present invention.
Figure 6B:
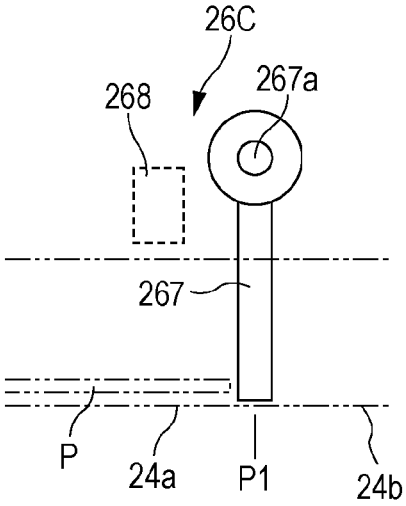

FIGS. 6A and 6B show the configuration of an example of the entry restricting unit 26 according to the third embodiment. The entry restricting unit 26C of the third embodiment includes an entry restricting plate 267 and an opening/closing member 268 for opening and closing the entry restricting plate 267 in synchronization with closing and opening of an exterior door of the image forming apparatus 1A that is not shown in the drawing.

In the entry restricting unit 26C, the entry restricting plate 267 is rotated around a shaft 267*a*, thereby opening or closing a conveying course of a paper sheet P at the boundary point P1 between the first reverse conveying path 24*a* and the second reverse conveying path 24*b*.

With the exterior door (not shown) of the image forming apparatus 1A being closed, as shown in FIG. 6A, the entry restricting plate 267 is being pushed up by the opening/closing member 268, so that the entry restricting unit 26C is held in a conveying course opening position from which the entry restricting plate 267 is retracted from the conveying course of the paper sheet P.

When the exterior door (not shown) of the image forming apparatus 1A is opened, as shown in FIG. 6B, the opening/closing member 268 separates from the entry restricting plate 267. Accordingly, the entry restricting plate 267 rotates under its own weight or by means of, for example, an urging spring that is not shown in the drawing, whereby the entry restricting unit 26C is held in a conveying course closing position where the entry restricting plate 267 projects into the conveying course of the paper sheet P.

During image formation, the exterior door (not shown) of the image forming apparatus 1A is closed, so that the entry restricting plate 267 is held in the conveying course opening position. Accordingly, in operation for the image formation on the paper sheet P that is of the size more than the predetermined size, such as a long paper sheet, the paper sheet P can be conveyed further from the first reverse conveying path 24*a* into the second reverse conveying path 24*b*. Consequently, the paper sheet P can undergo duplex printing or can be ejected after being reversed.

When the exterior door (not shown) of the image forming apparatus 1A is opened first for removal of the paper sheet P during, for example, jamming, the entry restricting plate 267 is held in the conveying course closing position. Accordingly, even when the paper sheet P moves under its own weight as the guide plate 200*c* is opened for removal of the paper sheet P during, for example, jamming with the pressure of the pairs of rollers of the conveying rollers 200 released for registration rocking, the paper sheet P abuts on the entry restricting plate 267, thus remaining in the first reverse conveying path 24*a*. The paper sheet P remaining in the first reverse conveying path 24*a* can be identified visually and removed with ease when the guide plate 200*c* is opened.

When the exterior door (not shown) of the image forming apparatus 1A is opened during, for example, jamming with the long paper sheet conveyed to a position where it lies astride the first reverse conveying path 24*a* and the second reverse conveying path 24*b*, the entry restricting plate 267 abuts on the long paper sheet. In this case, the entry restricting plate 267 can be rotated by hand, whereby the long paper sheet can be removed.

The present invention is applied to an apparatus including a reverse conveying path where a paper sheet of a regular size and a long paper sheet are reversed.

According to an embodiment of the present invention, the entry restricting unit is moved to the conveying course closing position, so that even when the guide plate is opened for removal of the paper sheet during jamming with the paper sheet of the size not more than the first size remaining in the first reverse conveying path, entry of the paper sheet moving under its own weight toward the second reverse conveying path is restricted. When the second reverse conveying path is entered by the paper sheet of the size not more than the first size, the paper sheet is hard to identify visually and is hard to remove.

For this reason, the entry restricting unit restricts the entry of the paper sheet of the size not more than the first size toward the second reverse conveying path, whereby the visual identification and the removal of the paper sheet in the first reverse conveying path are facilitated, thus reducing work of an operator.

Moreover, in the second reverse conveying path, needs for ensuring visibility and workability that exceed those of a conventional apparatus are eliminated. Consequently, the apparatus can be prevented from being increased in size and becoming complicated.

By being moved to the conveying course opening position, the entry restricting unit allows the paper sheet of the size more than the first size but not more than the second size to enter the first reverse conveying path and the second reverse conveying path. Accordingly, the paper sheet of the size more than the first size but not more than the second size can undergo duplex printing or can be ejected after being reversed.

Because the paper sheet of the size more than the first size but not more than the second size remains astride the first reverse conveying path and the second reverse conveying path, a portion of the paper sheet remains in the first reverse conveying path even when the guide plate is opened for removal of the paper sheet during jamming, whereby visual identification and the removal of the paper sheet are facilitated.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

at least one paper cassette configured to accommodate a paper sheet so that the paper sheet can be sent out;

an image forming section provided above the at least one paper cassette and configured to form an image on the paper sheet;

a main conveying path configured to convey the paper sheet to be formed with the image in the image forming section;

a control section; and a reverse conveying path configured to reverse the paper sheet, the reverse conveying path branching off from the main conveying path, wherein the reverse conveying path comprises:

a first reverse conveying path provided side by side with the at least one paper cassette and configured to extend vertically, the first reverse conveying path having a length more than a length of the paper sheet of a first size along a conveying direction, the paper sheet of the first size being accommodated by the at least one paper cassette, the length of the first reverse conveying path being less than a length of a paper sheet of a second size along the conveying direction, the second size being more than the first size;

a second reverse conveying path configured to connect from the first reverse conveying path and extend below the at least one paper cassette, the second reverse conveying path and the first reverse conveying path having a total length more than the length of the paper sheet of the second size along the conveying direction;

a guide plate configured to be moved from a first position in which a pair of paper conveying rollers of the first reverse conveying path applies pressure on the paper sheet while the paper sheet is in the first reverse conveying path, to a second position in which the pressure is released from the paper sheet while the paper sheet is in the first reverse conveying path, the pair of paper conveying rollers including a first roller attached to the guide plate; and an entry restricting unit provided at a boundary point between the first reverse conveying path and the second reverse conveying path, the entry restricting unit having a conveying course opening position and a conveying course closing position, wherein the control section is configured to execute such control as to move the entry restricting unit to the conveying course closing position when determining that the paper sheet of the first size and a paper sheet of a size less than the first size undergo image formation, and execute such control as to move the entry restricting unit to the conveying course opening position when determining that the paper sheet of the second size and a paper sheet of a size more than the first size and less than the second size undergo the image formation, the entry restricting unit, when in the conveying course opening position, allows the paper sheet to enter the second reverse conveying path from the first reverse conveying path, and the entry restricting unit, when in the conveying course closing position, prevents the paper sheet from entering the second reverse conveying path from the first reverse conveying path.

2. The image forming apparatus according to claim 1, further comprising an opening/closing detecting unit configured to detect whether the entry restricting unit is in the conveying course closing position or in the conveying course opening position, wherein the control section controls an operation section for such operation guidance as to move the entry restricting unit to the conveying course closing position when determining that the paper sheet of the size not more than the first size undergoes the image formation and also detecting by the opening/closing detecting unit that the entry restricting unit is in the conveying course opening position, and the control section controls the operation section for such operation guidance as to move the entry restricting unit to the conveying course opening position when determining that the paper sheet of the size more than the first size but not more than the second size undergoes the image formation and also detecting by the opening/closing detecting unit that the entry restricting unit is in the conveying course closing position.

3. The image forming apparatus according to claim 1, further comprising:

a driving unit configured to open and close the entry restricting unit, wherein the control section controls the driving unit to move the entry restricting unit to the conveying course closing position when determining that the paper sheet of the size not more than the first size undergoes the image formation and also detecting by an opening/closing detecting unit that the entry restricting unit is in the conveying course opening position, and the control section controls the driving unit to move the entry restricting unit to the conveying course opening position when determining that the paper sheet of the size more than the first size but not more than the second size undergoes the image formation and also detecting by the opening/closing detecting unit that the entry restricting unit is in the conveying course closing position.

4. The image forming apparatus according to claim 1, further comprising an opening/closing member configured to open and close the entry restricting unit in synchronization with closing and opening of a door, wherein the opening/closing member moves the entry restricting unit to the conveying course opening position when the door is closed, and the opening/closing member moves the entry restricting unit to the conveying course closing position when the door is opened.

5. The image forming apparatus according to claim 1, wherein movement of the guide plate from the first position to the second position causes the first roller of the pair of paper conveying rollers to move away from a second roller of the pair of paper conveying rollers.

6. The image forming apparatus according to claim 1, wherein the pair of paper conveying rollers of the first reverse conveying path is configured to rotate in forward and reverse directions, and the paper sheet is conveyed in the first reverse conveying path in forward and reverse directions by forward and reverse rotation of the pair of paper conveying rollers.

* * * * *